US010954696B2

(12) United States Patent
Grela et al.

(10) Patent No.: US 10,954,696 B2
(45) Date of Patent: Mar. 23, 2021

(54) STORAGE ASSEMBLY WITH A DRAWER HAVING A DRAWER PULL ASSEMBLY AND A METHOD FOR LOCKING A DRAWER

(71) Applicants: Larry Mitchell Grela, Plainfield, IL (US); Edwin Dizon Manalang, Burbank, IL (US); Qiang Chen, Long Grove, IL (US); Kai Kai Zhao, Cheng Guan Town (CN)

(72) Inventors: Larry Mitchell Grela, Plainfield, IL (US); Edwin Dizon Manalang, Burbank, IL (US); Qiang Chen, Long Grove, IL (US); Kai Kai Zhao, Cheng Guan Town (CN)

( * ) Notice: Subject to any disclaimer, the term of this patent is extended or adjusted under 35 U.S.C. 154(b) by 211 days.

(21) Appl. No.: 16/195,307

(22) Filed: Nov. 19, 2018

(65) Prior Publication Data

US 2020/0157842 A1 May 21, 2020

(51) Int. Cl.

| | |
|---|---|
| ***E05B 65/46*** | (2017.01) |
| ***B25H 3/02*** | (2006.01) |
| ***A47B 95/02*** | (2006.01) |
| ***A47B 31/00*** | (2006.01) |

(52) U.S. Cl.

CPC ..... *E05B 65/46* (2013.01); *A47B 2031/003* (2013.01); *A47B 2095/024* (2013.01); *A47B 2210/0016* (2013.01); *B25H 3/028* (2013.01)

(58) Field of Classification Search

CPC ..... E05B 65/46; B25H 3/028; E05C 3/14; A47B 95/02; A47B 2095/024

See application file for complete search history.

(56) References Cited

U.S. PATENT DOCUMENTS

| | | | |
|---|---|---|---|
| 1,170,231 | A | 2/1916 | Flint |
| 1,459,930 | A | 6/1923 | Riehle |
| 1,513,849 | A | 11/1924 | Moore |
| 1,936,867 | A | 11/1933 | Wetzel |
| 1,987,822 | A | 1/1935 | Gregory |
| 2,286,427 | A | 6/1942 | Levensten |
| 2,525,208 | A | 9/1946 | Clink |
| 2,981,549 | A | 4/1961 | Hotton |
| 3,070,340 | A | 12/1962 | Cohn |
| D205,523 | S | 8/1966 | Doman |
| 3,456,995 | A | 7/1969 | Nyquist |
| 3,520,583 | A | 7/1970 | Case |
| D229,262 | S | 11/1973 | Pearson |
| 3,848,942 | A | 11/1974 | Fanini |

(Continued)

FOREIGN PATENT DOCUMENTS

GB 2069915 A 9/1981

OTHER PUBLICATIONS

International Search Report for PCT Application No. PCT US 2010/001732, dated Aug. 5, 2010.

(Continued)

*Primary Examiner* — Andrew M Roersma

(74) *Attorney, Agent, or Firm* — John G. Chupa

(57) ABSTRACT

A storage assembly 10 having a drawer 12 and a drawer pull assembly 14 including a door handle 16 which allows the drawer 12 to selectively locked and unlocked as the drawer handle 16 is selectively pivoted about the drawer 12, and a method for locking and unlocking a drawer 12 by the selective articulation or pivoting of the drawer handle 16.

6 Claims, 5 Drawing Sheets

(56) References Cited

U.S. PATENT DOCUMENTS

| | | | | |
|---|---|---|---|---|
| 3,954,202 | A | 5/1976 | Petrick | |
| 4,108,514 | A | 8/1978 | Zimmerman | |
| 4,120,549 | A | 10/1978 | Bureau | |
| 4,211,455 | A | 7/1980 | Tedrow | |
| D258,175 | S | 2/1981 | Hazeltine | |
| 4,266,835 | A | 5/1981 | Schmidt | |
| 4,303,158 | A | 12/1981 | Perkins | |
| 4,365,720 | A | 3/1982 | Kaneshiro | |
| D271,733 | S | 12/1983 | Daventry | |
| D273,906 | S | 5/1984 | Norlin | |
| D283,263 | S | 4/1986 | Richey | |
| D292,937 | S | 11/1987 | Richey | |
| 4,830,198 | A | 5/1989 | Colquitt | |
| D337,404 | S | 7/1993 | Mile | |
| 5,292,191 | A | 3/1994 | Slivon | |
| D356,703 | S | 3/1995 | Dickinson | |
| 5,443,311 | A | 8/1995 | Kadlecek et al. | |
| 5,497,878 | A | 3/1996 | Sandonato | |
| D374,532 | S | 10/1996 | Pool | |
| D387,926 | S | 12/1997 | Blaesing | |
| 5,857,757 | A | 7/1999 | Bieker et al. | |
| 5,927,838 | A | 7/1999 | Hellman | |
| 5,951,129 | A | 9/1999 | Stein | |
| D423,817 | S | 5/2000 | Holcomb et al. | |
| D423,818 | S | 5/2000 | Holcomb et al. | |
| D427,807 | S | 7/2000 | Holcomb et al. | |
| D430,426 | S | 9/2000 | Bieker et al. | |
| D444,930 | S | 7/2001 | Brown | |
| D448,168 | S | 9/2001 | Johnston | |
| D448,586 | S | 10/2001 | O'hare | |
| 6,375,235 | B1 * | 4/2002 | Mehmen | E05B 65/46 292/128 |
| 6,422,386 | B1 | 7/2002 | Weise et al. | |
| 6,527,353 | B1 | 3/2003 | Bradfish et al. | |
| 6,578,938 | B2 | 6/2003 | Norman | |
| 6,811,232 | B2 | 11/2004 | Doan et al. | |
| D505,237 | S | 5/2005 | Schmidt et al. | |
| D514,854 | S | 2/2006 | Schmidt et al. | |
| D520,784 | S | 5/2006 | Schmidt et al. | |
| 7,048,347 | B1 * | 5/2006 | Liu | B25H 3/028 312/332.1 |
| D523,607 | S | 6/2006 | Huget | |
| 7,121,638 | B1 | 10/2006 | Eggert et al. | |
| D536,202 | S | 2/2007 | Mehmen et al. | |
| 7,268,518 | B1 | 9/2007 | Goff | |
| 7,296,808 | B2 | 11/2007 | Huget | |
| D563,119 | S | 3/2008 | Malley et al. | |
| RE40,267 | E | 4/2008 | Mehmen | |
| D574,628 | S | 8/2008 | Grela | |
| 7,510,078 | B2 | 3/2009 | Schmidt et al. | |
| 7,552,950 | B2 | 6/2009 | Scheffy et al. | |
| 7,784,887 | B2 | 8/2010 | Grela et al. | |
| D636,615 | S | 4/2011 | Grela | |
| 7,946,663 | B2 | 5/2011 | Holcomb | |
| D649,377 | S | 11/2011 | Manalang et al. | |
| 8,056,943 | B2 | 11/2011 | Scheffy et al. | |
| 8,056,995 | B2 | 11/2011 | Grela et al. | |
| 8,084,992 | B2 | 12/2011 | Scheffy et al. | |
| D654,776 | S | 2/2012 | Retchloff | |
| 8,157,337 | B2 | 4/2012 | Manalang et al. | |
| D660,462 | S | 5/2012 | Chen | |
| 8,215,728 | B2 | 7/2012 | Mehmen | |
| 8,240,786 | B2 | 8/2012 | Daino et al. | |
| D671,388 | S | 11/2012 | Retchloff | |
| D677,934 | S | 3/2013 | Grela | |
| D678,694 | S | 3/2013 | Grela | |
| 8,613,456 | B2 | 4/2013 | Grela | |
| 8,608,261 | B2 | 12/2013 | Retchloff | |
| 8,827,387 | B2 | 4/2014 | Grela | |
| 8,944,537 | B1 * | 2/2015 | Manalang | E05B 65/46 312/332.1 |
| 9,010,886 | B2 | 4/2015 | Grela | |
| 9,181,731 | B2 | 5/2015 | Grela et al. | |
| 9,050,718 | B2 | 6/2015 | Cole | |
| D747,875 | S | 1/2016 | Manalang et al. | |
| 9,388,609 | B2 | 7/2016 | Grela et al. | |
| 9,422,750 | B2 * | 8/2016 | Gutierrez | E05B 65/46 |
| 9,630,312 | B2 | 4/2017 | Grela et al. | |
| 9,894,996 | B1 | 2/2018 | Grela et al. | |
| 9,984,996 | B2 | 2/2018 | Grela et al. | |
| 9,914,209 | B2 | 3/2018 | Grela et al. | |
| 10,145,158 | B2 | 5/2018 | Grela et al. | |
| 10,293,478 | B2 | 5/2019 | Grela | |
| 10,702,984 | B2 | 7/2020 | Grela | |
| 2005/0204646 | A1 | 9/2005 | Tupper et al. | |
| 2006/0103278 | A1 * | 5/2006 | Bousquet | B25H 3/028 312/332.1 |
| 2008/0150407 | A1 * | 6/2008 | Mehmen | E05B 65/46 312/332.1 |
| 2008/0276667 | A1 | 11/2008 | Scheffey et al. | |
| 2008/0278046 | A1 | 11/2008 | Scheffy | |
| 2009/0195134 | A1 * | 8/2009 | Liu | E05B 65/46 312/348.6 |
| 2010/0019636 | A1 * | 1/2010 | Chen | E05B 65/46 312/332.1 |
| 2010/0072716 | A1 | 3/2010 | Grela | |
| 2010/0276317 | A1 | 11/2010 | Grela et al. | |
| 2010/0282629 | A1 | 11/2010 | Grela | |
| 2010/0314978 | A1 | 12/2010 | Manalang et al. | |
| 2011/0121701 | A1 | 5/2011 | Chang | |
| 2011/0309730 | A1 | 12/2011 | Retchloff et al. | |
| 2015/0061483 | A1 * | 3/2015 | Liu | E05B 65/46 312/332.1 |

OTHER PUBLICATIONS

U.S. Pat. No. 3,930,484.

Matco Tools Catalog—At least as early as Oct. 29, 2014.

Notification of First Office Action (including Search Report)—The State Intellectual Property Office of The People's Republic of China (dated May 21, 2013) App No. 201080026995.9.

European Search Report—dated Jun. 25, 2014—Application No. 10166026.4-1701/2263836.

European Search Report—dated Jun. 18, 2014—Application No. EP-10-16-6026.

Notice of References Cited—U.S. Appl. No. 13/998,368, filed Oct. 25, 2013.

* cited by examiner

STORAGE ASSEMBLY WITH A DRAWER HAVING A DRAWER PULL ASSEMBLY AND A METHOD FOR LOCKING A DRAWER

GENERAL BACKGROUND

Field of the Invention

The present invention generally relates to a novel storage assembly having a novel drawer assembly including a novel drawer pull assembly and more particularly, by way of example and without limitation, a new and novel tool box storage assembly having a drawer which may be easily and selectively moved from a selectively stored and locked position to an unlocked and open position and to a method for locking a drawer.

Background of the Invention

Storage assemblies are used to selectively and removably receive a wide variety of items and have a plethora of shapes, sizes, and features. One such feature or component of many of these storage assemblies is a drawer which receives one or more items and which is typically and selectively movable from a first closed or stored position in which the drawer typically and wholly resides within the body of the storage assembly to a second position in which the drawer is remote from the body of the storage assembly, thereby exposing the stored item(s) and allowing the stored item(s) to be accessed and removed for use.

It is also highly desirable to allow these drawers to be selectively locked and unlocked while residing within the storage assembly in order to reduce the probability of having unauthorized access to the stored item(s) respectively residing within the drawers and reducing the probability of having the drawers inadvertently opening and allowing the stored item(s) to be inadvertently dislodged from their respective stored position. It is also highly desirable to allow these drawers to be quickly grasped and moved into and out of these two positions.

While current drawers do have respective locking and pulling or grasping assemblies, these assemblies are typically complicated, costly to manufacture, and costly to service and may not easily and readily allow the drawers to be easily locked and unlocked.

There is therefore a need for a new and novel storage assembly, a new and novel drawer assembly, and a new and novel drawer pull assembly which overcomes all or some of the disadvantages of prior such assemblies in a new and novel manner and the various inventions which are more fully delineated herein provide such benefits, including but not limited to a new and novel method for selectively locking a drawer.

SUMMARY OF THE INVENTION

It is a first non-limiting object of the present inventions to provide a storage assembly which overcomes some or all of the various disadvantages of prior such assemblies.

It is a second non-limiting object of the present inventions to provide a drawer assembly which overcomes some or all of the various disadvantages of prior drawer assemblies.

It is a third non-limiting object of the present inventions to provide a drawer pull assembly which overcomes some or all of the various disadvantage of prior drawer pull assemblies.

It is a fourth non-limiting object of the present invention to provide a method for selectively locking a drawer which overcomes some or all of the various disadvantages of prior such methods.

According to one non-limiting aspect of the present invention, a drawer pull assembly is provided and comprises a handle which selectively pivots about a drawer and selectively locks and unlocks the drawer as the handle is selectively pivoted about the drawer.

According to a second non-limiting aspect of the present invention, a drawer pull assembly for use in combination with a drawer is provided. Particularly, the drawer pull assembly includes a first portion which extends through the drawer; and a securing member which pivotally attaches the first portion to the drawer, whereby said securing member allows said first portion to selectively and reciprocally move the drawer in opposed directions and further allows the first portion to be selectively pivoted about the drawer, effective to lock the drawer in order to prevent the selective and reciprocal movement from occurring.

According to a third non-limiting aspect of the present invention, a drawer assembly is provided and includes a drawer having a drawer handle; a securing member which extends through the drawer and which pivotally couples the door handle to the drawer, whereby the securing member allows the drawer handle to selectively and reciprocally move the drawer in opposed directions and further allows the drawer handle to be selectively pivoted about the drawer, effective to lock the drawer in order to prevent the selective and reciprocal movement from occurring.

According to a fourth non-limiting aspect of the present invention, a storage assembly is provided and includes a first hollow body having a catch portion; a drawer having a second hollow body which is selectively and movably disposed within the first body, wherein the drawer includes a drawer handle having an opening; a member which traverses the opening and which pivotally couples the drawer handle to the second body, thereby allowing the drawer handle to selectively pivot about the second body from a first position in which the drawer handle engages the catch portion, thereby selectively locking the drawer to a second position in which the drawer handle is remote from the catch portion, thereby selectively allowing the drawer to be opened.

According to a fifth non-limiting aspect of the present inventions, a method for locking a drawer is provided and includes the steps of pivoting a drawer handle in a first direction; and causing the pivoting of the drawer handle to lock the drawer.

These and other features, advantages, and aspects of the present inventions will become apparent from a reading of the following detailed description of the preferred embodiment of the inventions, including the claims, and by reference to the drawings which are attached and made an integral part of this description.

DETAILED DESCRIPTION OF THE PREFERRED EMBODIMENT OF THE INVENTION

Figure 1:
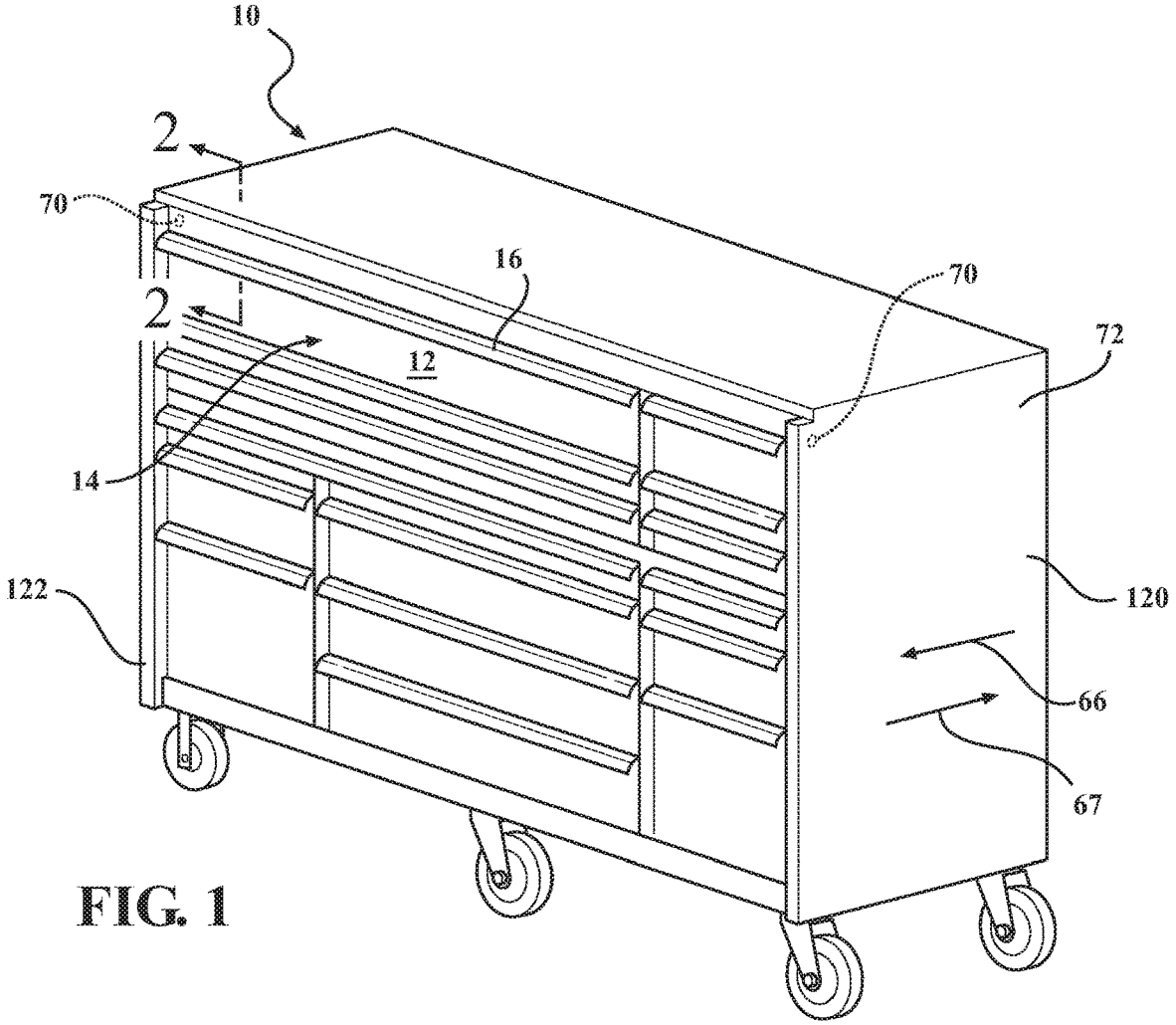
FIG. 1 is a front perspective view of a storage assembly which is made in accordance with the teachings of the preferred embodiment of the various inventions and incorporating a drawer and a drawer pull assembly which are also respectively made in accordance with the teachings of the preferred embodiment of the various inventions.
Figure 9:
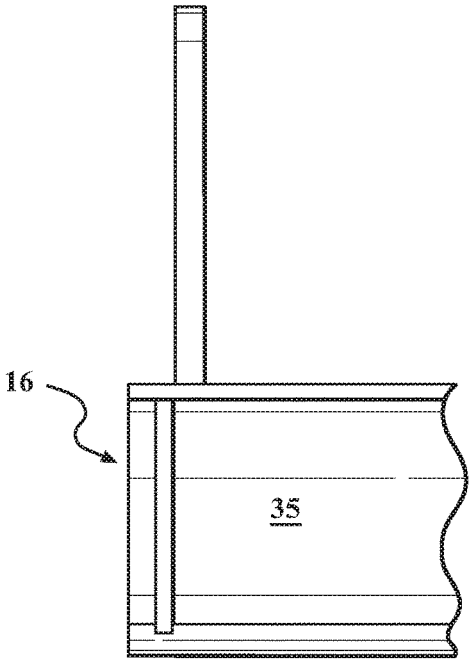
FIG. 9 is a view of the portion which is shown, for example, in FIGS. 2, 3, 5, 8, and 10 and which is taken in the direction of view arrow "9".
Figure 3:
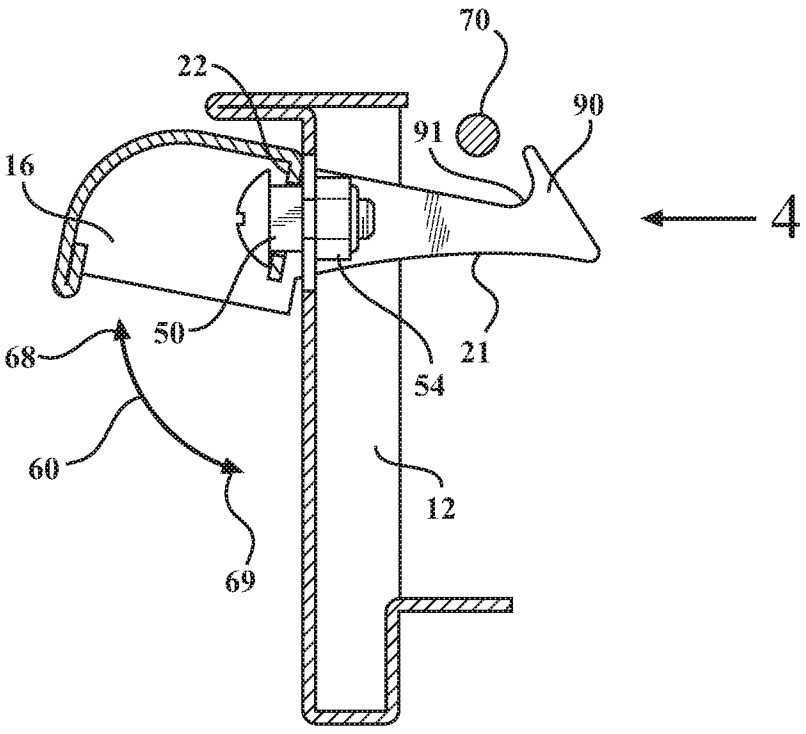
FIG. 3 is a view which is similar to the view which is shown in FIG. 2, but further showing selective movement by the drawer pull assembly to an open position.
Figure 2:
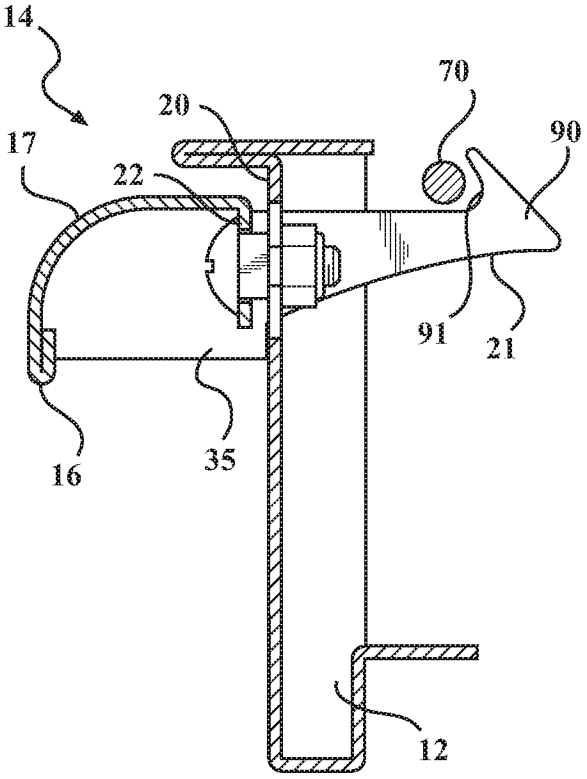
FIG. 2 is a side sectional view of a portion of the storage assembly which is shown in FIG. 1 and taken along view line "2-2".
Figure 4:
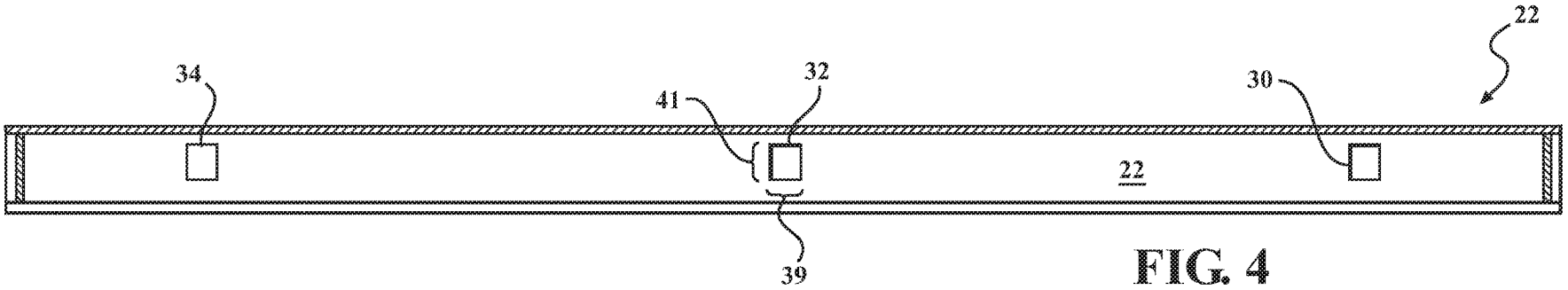
FIG. 4 is a partial sectional back view of a portion of the drawer pull assembly which is shown, for example, in FIGS. 1-3 and 10, and which is taken along sectional line "4-4" shown in FIG. 10.

Referring now to FIG. 1, there is shown a storage assembly 10 which is made in accordance with the teachings of a preferred embodiment of the various inventions. It should be realized that storage assembly 10 may selectively and removably store tools and associated tool type items or a wide variety of other dissimilar items. Nothing in this description or this Application is meant to limit the present inventions to a particular type of storage assembly, or to a storage assembly of a particular geometric configuration. Rather storage assembly 10 is meant to illustrate only one non-limiting example of a storage assembly which may be constructed in accordance with the teachings of the present inventions and may be of substantially any size, shape, or geometric configuration, have any number and type of drawers, and may be adapted to store a wide variety of dissimilar items.

The storage assembly 10 includes at least one drawer 12 having a drawer pull assembly 14 which is made in accordance with the teachings of the preferred embodiment of the inventions. In other non-limiting configurations, some or all of the drawers of the storage assembly 10 have the drawer pull configuration of the preferred embodiment of the inventions deployed thereon or operatively attached thereto. However, it should be realized that not all of the drawers 12 of the storage assembly 10 need or have the drawer pull assembly 14 which is described below.

The drawer pull assembly 14 which is used in combination with drawer 12 will now be explained in further detail, but it should be realized that similar assemblies to assembly 14 may also be deployed in combination with some or all of the drawers of the storage assembly 10 and that their respective structure and operation is similar to that of the drawer pull assembly 14 which will now be explained in greater detail.

As shown best in FIGS. 2-4, 9, and 10, the drawer pull assembly 14, of a first non-limiting embodiment of the various inventions, includes a pull handle 16 which is selectively and pivotally attached to the flat front face 20 of the drawer 12 by at least one connection or securing member 50.

In one non limiting embodiment, pull handle 16 includes a generally flat internal face 22 having a plurality of substantially identical and spaced apart rectangular openings 30, 32, 34 and a curved front portion 17 which is spaced apart from and linearly coextensive to the generally flat internal face portion 22, whereby the internal flat face portion 22 and the front portion 17 cooperatively form a hollow trench 35 which, in the preferred embodiment of the various inventions, has a size and a shape to facilitate the placement of at least one finger therein in order to allow the handle 16 to be grasped in and selectively articulated by a hand of a user. The handle 16 further includes a pair of integrally formed curved and opposed wing portions 19, 21 which are integrally formed with and integrally terminate upon the external flat face portion 79 (which is opposite to the internal flat face portion 22), while integrally and respectively emanating from respective and opposed longitudinal ends 7,9 of the handle 16. Openings 30, 32, 34 respectively traverse both opposed surfaces 22, 79. In one non-limiting embodiment of the various inventions, each of the wing portions 19, 21 are substantially identical and respectively include a hook end 90 forming a notch 91. In the most preferred, although non-limiting embodiment of the various inventions, each opening 30-34 has a respective width 39 which is shorter than their respective length 41. In one non-limiting embodiment of the various inventions, opening 34 is formed and occurs upon the internal wall portion 22 close to the end 9, opening 30 is formed and occurs upon the internal wall portion 22 close to the end 7, and opening 32 is formed and occurs upon the internal wall portion 22 midway between openings 30, 34.

The drawer pull assembly 14 further includes a first connection or securing member 50 (such as, by way of example and without limitation a screw which is shown, for example, in FIGS. 2-3, 5-8, and 11-12) which is received into the formed trench 35 and then into the hollow opening 34 formed in the wall 22 before traversing the faces 22 and 79 of handle 16 and the front face 20 of the drawer 12. The portion 51 of the connection member 50 which passes through the front face 20 of the drawer 12 (e.g., typically the portion 51 is completely or mostly threaded in one non-limiting embodiment of the inventions) receives a fastener (such as, by way of example and without limitation a nut 54), and the fastener 54 secures the screw 50 to the drawer 12. The combination of the securing member 50 and the fastener 54 may be replaced, in an alternate embodiment of the invention, by a single member such a pierce nut or similar members. In similar fashion, a connection member 50 may traverse opening 30 and the front face 20 of the drawer 12 and be secured by a fastener 54, while a third connection or securing member 50 may traverse opening 32 and the front face 20 of the drawer 12 and receive a fastener member 54. Each of these respective connection or securing members (and their associated and respective fasteners 54) may be replaced by a respective single member, such as a pierce nut or similar type of connection or securing member, in various alternate and non-limiting embodiments of the invention. In one non-limiting embodiment of the invention, each of the utilized securing or connection members are substantially identical and each of the fasteners 54 are also substantially identical. In one non-limiting embodiment of the inventions, the traversal of respective portions 51 through the drawer front face 20 may be achieved by the use of respective pre-formed "through" type holes or openings 101 made in and through the front face 20 and back face 11, and which are respectively axially aligned and communicate with a respective unique one of the "through" holes or openings 30, 32, 34.

The respective larger non-threaded portions 59 of each of the connection members 50 do not and are prevented from, in one non-limiting embodiment of the various inventions, from traversing through respective openings 30, 32, 34 because each of the respective portions 59 are respectively larger than the respective openings 30, 32, 34 (e.g., respective heights 5 are larger than the respective lengths 41 and respective widths 1 are larger than the respective widths 39). Each wing portion 19, 21 respectively and movably extends through the drawer 12 (e.g., through the front face 20 and through the back face 11), by the use of substantially identical slots 93 formed through faces or surfaces 20,11. In one non-limiting embodiment of the various inventions, the respective length 99 of each substantially similar slot or opening 93 are larger than the respective lengths 97 of each substantially identical wing portion 19, 21 which respectively extends through respective openings 93, thereby allowing the wing portions 19, 21 to be selectively moved in directions 68, 69 and along arc 60. The respective width 87 of each slot 93 is also larger than the respective widths 85 of each wing portion 19, 21, thereby allowing the received wing portions 19, 21 to be selectively moved in directions 61, 63. In other non-limiting embodiments, the wing portions 19, 21 are dissimilar.

Thus, the securing or connection members 50 (and their respective fasteners 54) cooperatively and pivotally fasten the pull handle 16 (and the integrally formed wing portions 19, 21) to the front surface 20 of the drawer 12 and allow the pull handle 16 to pivot about the face 20 of the drawer 12, while remaining attached to the face 20. It should now be appreciated that, in the most preferred although non-limiting embodiment of the invention, each of the openings 30, 32, 34 is slightly larger than the respectively received portions 51 of the connection or securing members 50, thereby allowing the handle 16 to move about the face 20 and to allow the wings 19, 21 to pivot about the front face 20. The selective movement of the handle 16 typically occurs when hand or fingers of a user is/are deployed within the formed trench 35 causing desired articulation and movement of the handle 16. Moreover, because the difference between the respective length 41 of each respective opening 30, 32, 34 and the respective lengths 78 of each respective thinner portion 51 is greater than the difference between the respective widths 39 and the respective widths 3 of each respective thinner portion 51, there exists more movement along arc 60 then along reciprocal directions 61, 63. In another non-limiting embodiment, these differences are substantially equal and there is no substantial dissimilarity of movement.

In one non-limiting embodiment of the various inventions each respective length 41 is substantially identical and each respective width 39 is substantially identical. Further, the respective width 3 of each respective portion 51 is slightly smaller than each respective width 39, and the respective height 78 of each portion 51 is also slightly smaller than each respective height 41

Particularly, as shown, the drawer handle 16 selectively pivots along and about the arc 60 and further allows the drawer 12 to be selectively and reciprocally moved in opposed respective directions 66,67. The movement along direction 66 is one in which the drawer 12 is "pulled out of" the storage assembly 12 by a user who typically places a hand or a part of a hand in the formed trench 35 and pulls the drawer 12 in the direction 66, while movement along direction 67 is one in which the drawer 12 is "moved into" the storage assembly 12, again by a user who typically causes such movement by placing a hand or a portion of a hand into the formed trench 35 and applying force in the direction 67. Such selective motion (along directions 66,67) may be facilitated by commercially available and conventional ball bearing assemblies (not shown) which couple the drawer sides, such as side 4 to the internal portion of the body 72 of the storage assembly 10.

Particularly, when the drawer or pull handle 16 is moved along the direction 69 of the arc 60, the respectively formed notches 91 of the respective hook portions 90 of each respective wing portion 19, 21 the drawer are made to engage respective and substantially identical protruding members 70 which are formed upon and connected to the body 72 of the storage assembly 12, thereby locking the drawer 12 and preventing the drawer 12 from being moved to an open position along direction 66. That is, substantially identical protruding members 70 are formed upon each opposed side 120, 122 of the body 72. Alternatively, when pull handle 16 is moved along the direction 68 of the arc 60, the respective notched portions 91 of each wing member 19, 21 are made to selectively disengage or to be remote from their respective and associated members 70, thereby allowing the drawer 12 to be opened or selectively moved along the direction 66. It is this selective engagement of the notches 91 with members 70 which selectively lock the drawer 12 (when the drawer 12 resides within body 72) and it is this selective disengagement of the notches 91 with the members 70 which selectively unlock the drawer 12 (when the drawer 12 resides within the body 72).

Figure 6:
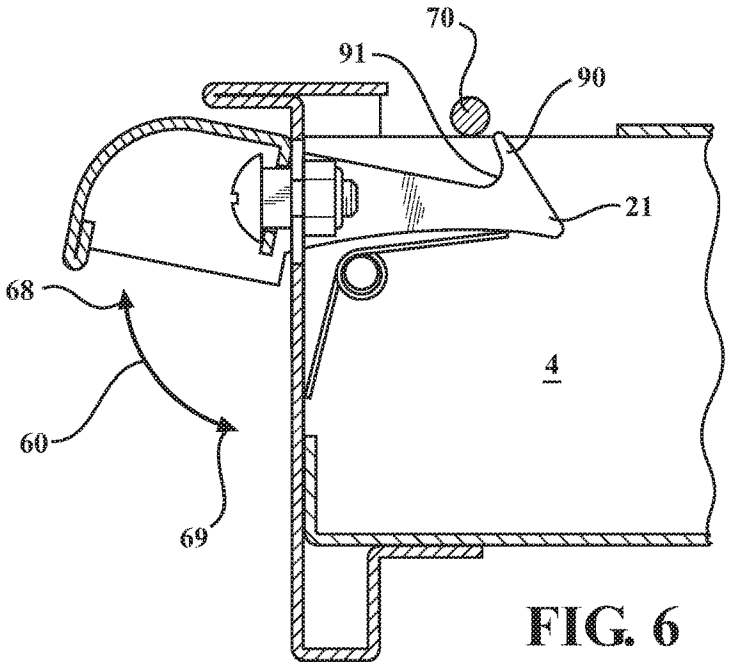
FIG. 6 is a view which is similar to that which is shown in FIG. 3 but which is made in accordance with the teachings of an alternate embodiment of the inventions.
Figure 5:
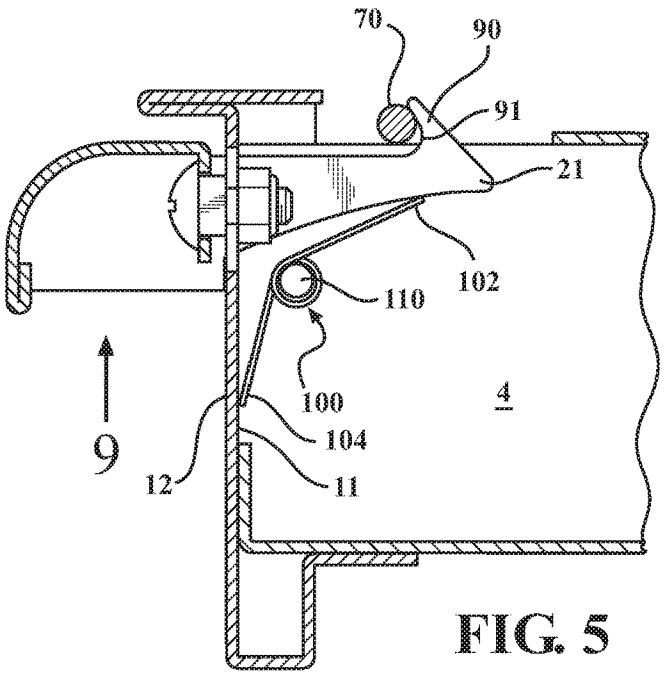
FIG. 5 is a view which is similar to that which is shown in FIG. 2 but which is made in accordance with the teachings of an alternate embodiment of the inventions.
Figure 8:
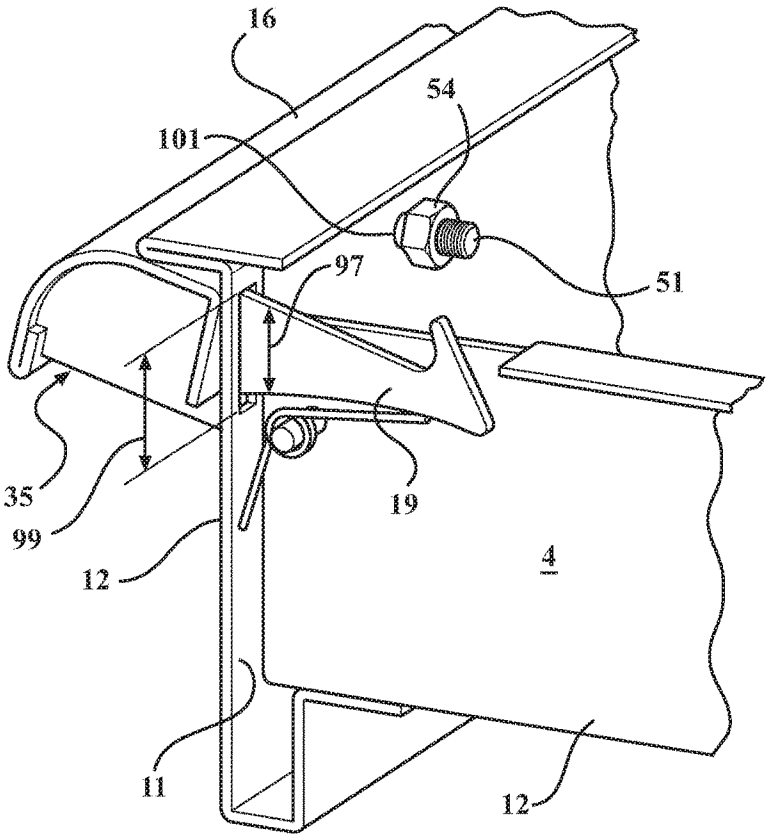
FIG. 8 is a view which is similar to that which is shown in FIG. 7 but which depicts the drawer selectively placed in an unlocked position.
Figure 7:
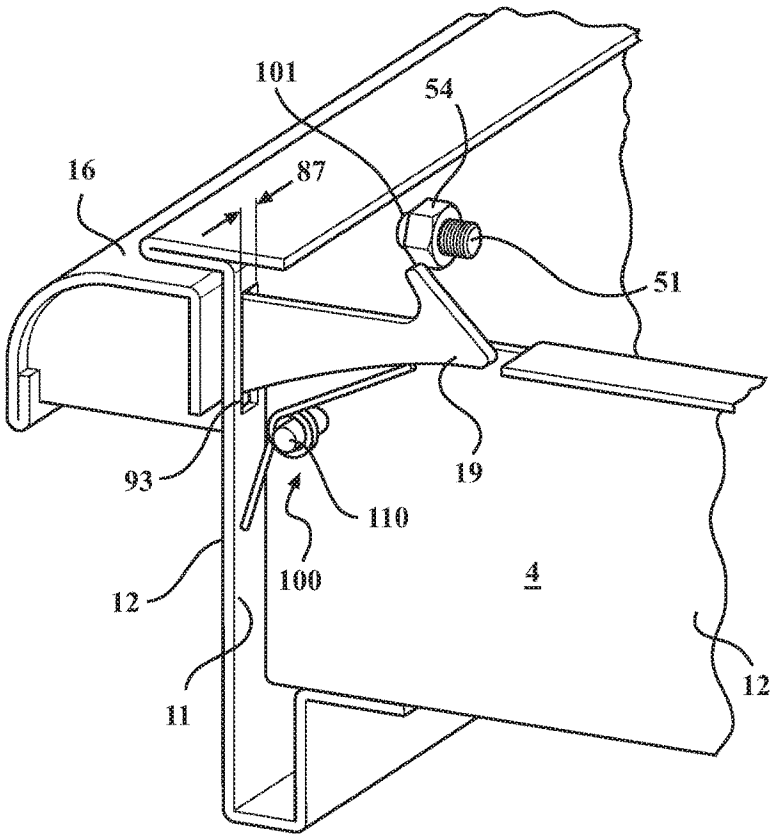
FIG. 7 is a side sectional view of the portion of the storage assembly shown in FIG. 1 opposite to that which is shown in FIGS. 5 and 7 and made in accordance with the teachings of the alternate embodiment of the invention and which further depicts the drawer selectively placed in a locked position.
Figures 10, 11, 12:
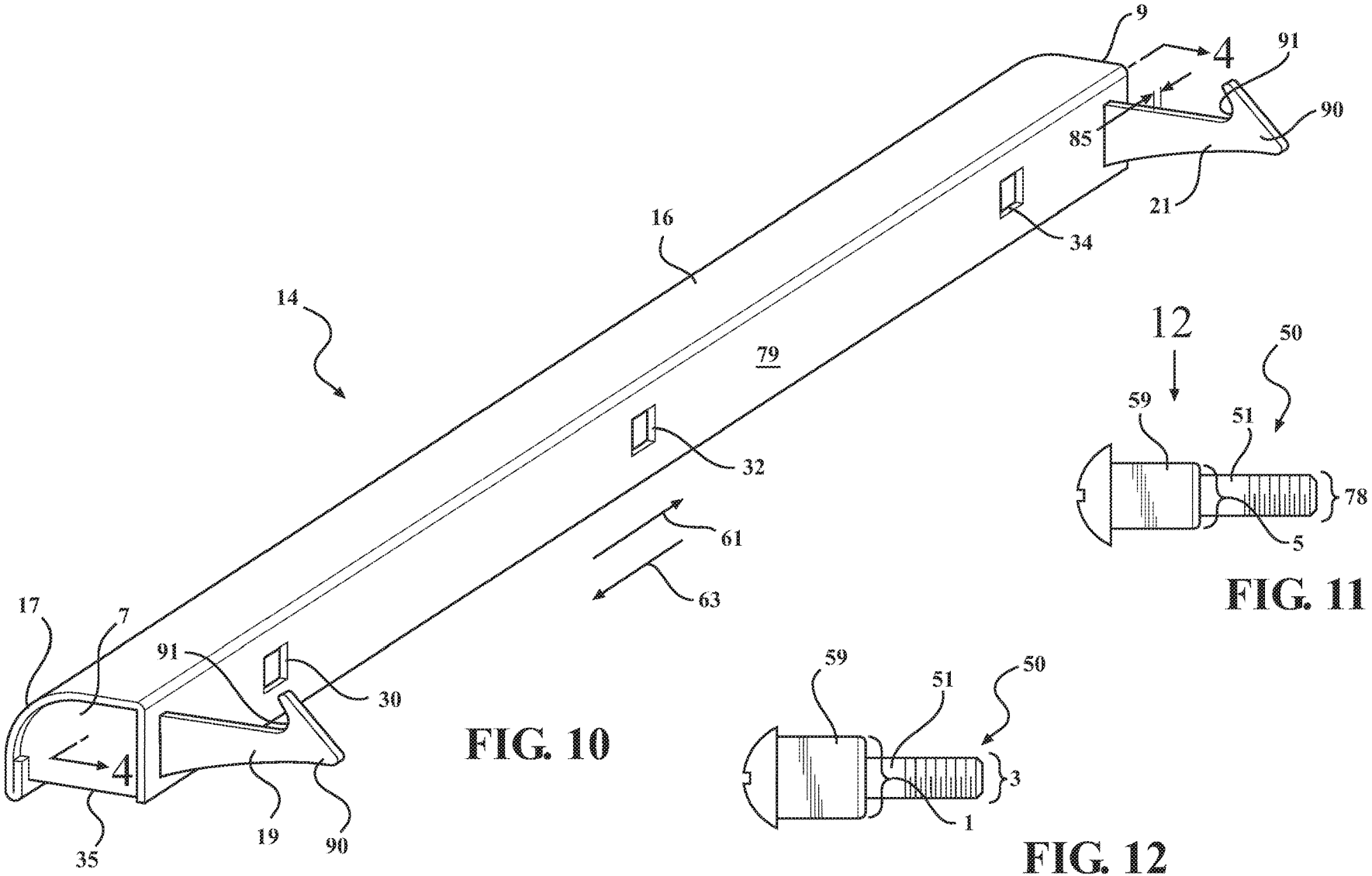
FIG. 10 is a perspective view of the drawer pull assembly, which is made in accordance with the teachings of the preferred embodiment of the invention, and which is shown in FIGS. 1-3 and 5-7.
FIG. 11 is a side view of the connection or securing member which is shown, for example, in FIGS. 2-3 and 5-8.
FIG. 12 is a view of the connection or securing member which is shown in FIG. 11 taken in the direction of view arrow "12".

In a non-limiting alternate embodiment of the invention, as shown best in FIGS. 5-8, a respective biasing spring 100 is deployed to upwardly bias the respective hook portions 90 of the respective wings 19, 21. The illustrations of FIGS. 5-6 show on such biasing spring 100 operatively attached to the wing portion 21 and it should be realized that this arrangement, in one non-limiting embodiment of the various inventions, is substantially similar with respect to the other wing portion 19 (shown in FIGS. 7-8) and thus the discussion of this biasing spring arrangement with respect to wing portion 21 is substantially describes the biasing spring arrangement associated with wing portion 19.

The biasing spring 100 biases the wing 21 in the "drawer closed position" since the biasing spring moves or forces the notch portion 91 of the wing portion 21 to engage the member 70. Particularly, the spring 100 has a first end 102 which contacts the portion 90 and upwardly biases the notch portion 91 of the wing portion 90 against the member 70, and a second end 104 which contacts the back face 11 of the drawer 12 and which is pivotally attached to a member or stud 110 which is mounted upon the side surface 4 of the drawer 12. This upward bias made be countered by moving the drawer pull portion 16 in the direction 69. In one non-limiting embodiment of the various inventions, each member 70 is generally round.

It is to be understood that the present inventions are not limited to the exact construction or method which has been illustrated, but that various modifications may be made without departing from the spirit and the scope of the inventions as they are delineated in the following claims. It should be appreciated that the foregoing inventions comprise an assembly which allows a drawer to be locked and unlocked by the simple articulation of a door pull handle assembly which is pivotally connected to a drawer and which further allows the drawer to be easily moved out of and into the body of a storage assembly by use of a very elegant and cost effective arrangement. It should further be appreciated that the foregoing inventions also described and comprise a method for selectively locking and unlocking a drawer by the simple and selective articulation or pivoting of a drawer pull assembly.

What is claimed is:

1. A storage assembly comprising a hollow body; a catch member which is disposed upon a wall of said hollow body and which protrudes into an interior of said hollow body; a drawer which is movably disposed within said hollow body and which selectively moves from a first open position in which said drawer is remote from said interior of said hollow body, to a second closed position in which said drawer resides within said interior of said hollow body, said drawer having a side surface and opposed front and back face surfaces, and wherein a pair of substantially identical and longitudinally opposed slots are formed through said opposed front and back face surfaces; and a drawer pull assembly comprising a pull handle having opposed flat external and flat internal faces, wherein a plurality of substantially identical and spaced apart openings are formed through each of said opposed flat internal and flat external faces and wherein said plurality of substantially identical and spaced apart openings are in a co-linear relation to each other, said pull handle further having a curved portion which is spaced apart from said flat internal face, which integrally terminates upon, protrudes from, and is linearly co-extensive to said flat external face, and which is linearly coextensive to said flat internal face, whereby said flat internal face and said curved portion co-operate to form a hollow trench, and said pull handle further having a pair of substantially identical and curved wing portions which are respectively and integrally disposed upon and protrude from opposed longitudinal ends of said flat external face, said drawer pull assembly further comprising a plurality of fasteners which are each respectively disposed through a unique one of said plurality of substantially identical and spaced apart openings, and wherein each of said substantially identical and curved wing portions respectively traverse a unique one of said pair of substantially identical and longitudinally opposed slots, and wherein said plurality of fasteners co-operatively and movably attach said pull handle to said front face surface of said drawer, effective to allow said pull handle to selectively move said drawer from said first open position to said second closed position and which further allows said pull handle to rotate with respect to said front face surface of said drawer, and said drawer pull assembly further comprising a biasing spring which is disposed upon said side surface of said drawer, and which has a first end which engages one of said pair of substantially identical and curved wing portions and a second opposed end which engages said back face surface of said drawer, and wherein said biasing spring pushes said one of said pair of substantially identical and curved wing portions against said catch member effective to normally lock said drawer when said drawer is in said second closed position, and wherein said rotation of said pull handle is effective to compress said biasing spring and cause said one of said pair of substantially identical and curved wing portions to be disengaged from said catch member, thereby allowing said drawer to be moved to said first open position from said second closed position.

2. A storage assembly comprising a hollow body; a catch member which is disposed upon a wall of said hollow body and which protrudes into an interior of said hollow body; a drawer which is movably disposed within said hollow body and which selectively moves from a first open position in which said drawer is remote from said interior of said hollow body, to a second closed position in which said drawer resides within said interior of said hollow body, said drawer having a side surface and opposed front and back face surfaces, and wherein a pair of substantially identical and longitudinally opposed slots are formed through said opposed front and back face surfaces; and a drawer pull assembly comprising a pull handle having opposed flat external and flat internal faces, wherein a plurality of substantially identical and spaced apart openings are formed through each of said opposed flat internal and flat external faces and said plurality of substantially identical and spaced apart openings are in a co-linear relation to each other, and said pull handle further having a curved portion which is spaced apart from said flat internal face, which integrally terminates upon, protrudes from, and is linearly co-extensive to said flat external face, and which is linearly coextensive to said flat internal face, whereby said flat internal face and said curved portion co-operate to form a hollow trench which is linearly coextensive to said flat external face, and said pull handle further having a pair of substantially identical and curved wing portions which are respectively and integrally disposed upon and protrude from opposed longitudinal ends of said flat external face, and wherein said plurality of substantially identical and spaced apart openings are disposed between said pair of substantially identical and curved wing portions, said drawer pull assembly further comprising a plurality of fasteners which are each respectively disposed through a unique one of said plurality of substantially identical and spaced apart openings, and wherein each of said substantially identical and curved wing portions respectively traverse a unique one of said pair of substantially identical and longitudinally opposed slots, and wherein said plurality of fasteners co-operatively and movably attach said pull handle to said front face surface of said drawer, effective to allow said pull handle to selectively move said drawer from said first open position to said second closed position and which further allows said pull handle to rotate with respect to said front face surface of said drawer, and said drawer pull assembly further comprising a biasing spring which is disposed upon said side surface of said drawer, and which has a first end which engages one of said pair of substantially identical and curved wing portions and a second opposed end which engages said back face surface of said drawer and wherein said biasing spring pushes said one of said plurality of wing portions against said catch member effective to normally lock said drawer when said drawer is in said second closed position, and wherein said rotation of said pull handle is effective to compress said biasing spring and cause said one of said pair of substantially identical and curved wing portions to be disengaged from said catch member, thereby allowing said drawer to be moved to said first open position from said second closed position.

3. The storage assembly of claim 2 wherein one of said plurality of substantially identical and spaced apart openings is disposed in the middle of said flat external face of said drawer pull handle assembly.

4. The storage assembly of claim 3 wherein each of said plurality of substantially identical and spaced apart openings are rectangular.

5. The storage assembly of claim 2 wherein said plurality of fasteners are substantially identical.

6. The storage assembly of claim 2 wherein said catch member is round.

* * * * *